United States Patent [19]

Bailey et al.

[11] Patent Number: 4,634,515

[45] Date of Patent: Jan. 6, 1987

[54] NICKEL ADSORBENT FOR SULFUR REMOVAL FROM HYDROCARBON FEEDS

[75] Inventors: George W. Bailey; George A. Swan, both of Baton Rouge, La.

[73] Assignee: Exxon Research and Engineering Company, Florham Park, N.J.

[21] Appl. No.: 791,532

[22] Filed: Oct. 25, 1985

[51] Int. Cl.[4] ..... C10G 25/00; C10G 45/00; C10G 67/06

[52] U.S. Cl. ..... 208/91; 208/89; 208/97; 208/99; 208/217; 208/60

[58] Field of Search ..... 208/97, 89, 91, 60, 208/217, 99

[56] References Cited

U.S. PATENT DOCUMENTS

| | | | |
|---|---|---|---|
| 2,463,741 | 3/1949 | Byrns | 208/97 |
| 3,509,044 | 4/1970 | Adams et al. | 208/217 |
| 3,770,617 | 11/1973 | Riley et al. | 208/217 |
| 4,419,224 | 12/1983 | Miller et al. | 208/91 |
| 4,446,005 | 5/1984 | Eberly, Jr. et al. | 208/217 |

*Primary Examiner*—Andrew H. Metz
*Assistant Examiner*—Chung K. Pak
*Attorney, Agent, or Firm*—Llewellyn A. Proctor

[57] ABSTRACT

An improved sulfur trap for the sulfur level reduction of a reformer feed leaving a hydrofiner to render it suitable for use in a reforming unit employing a sulfur-sensitive reforming catalyst. The nickel catalyst contained in said sulfur trap is one wherein the average crystallite size of the nickel is at least about 75Å, and at greater than 50 percent of the nickel is in reduced state, based on the total weight of the supported component.

11 Claims, 1 Drawing Figure

FIGURE
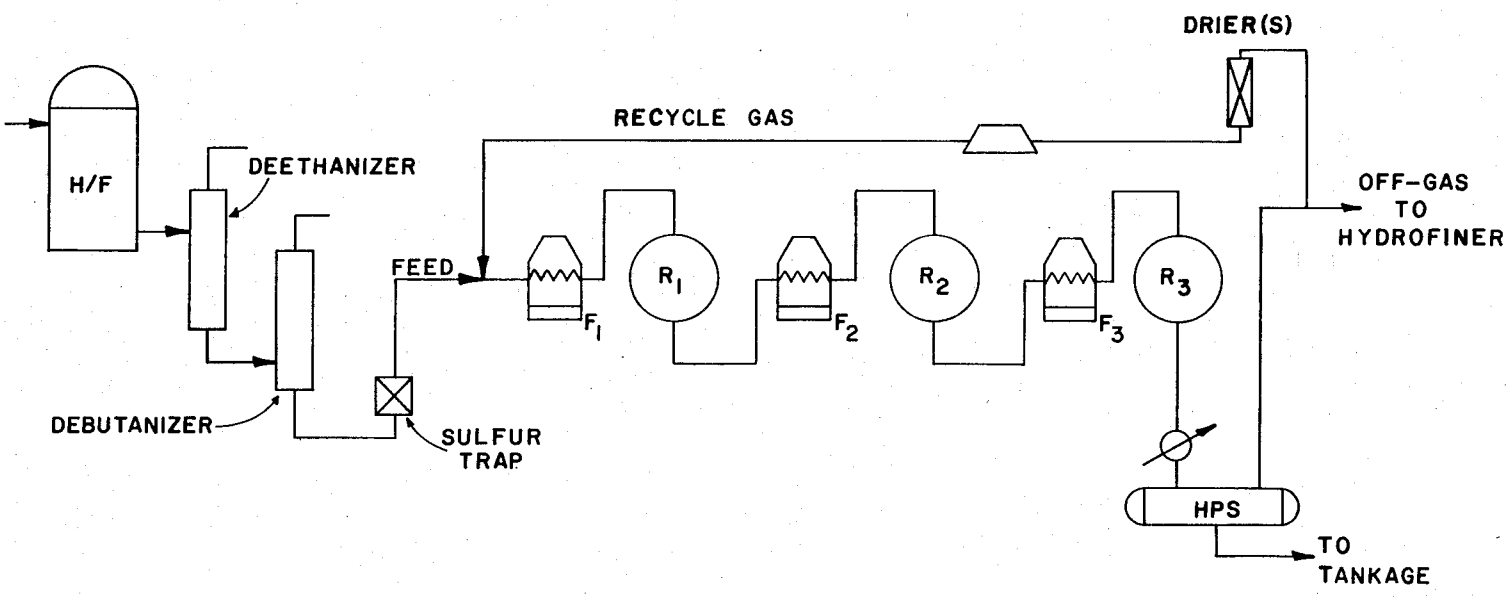

NICKEL ADSORBENT FOR SULFUR REMOVAL FROM HYDROCARBON FEEDS

I. FIELD OF THE INVENTION

This invention relates to improvements in "sulfur traps" or guard chambers for the removal of sulfur from sulfur-containing hydrocarbon feeds. In particular, it relates to an improved sulfur trap for the sulfur level reduction of a reformer feed leaving a hydrofiner to render it suitable for use in a reforming unit employing a sulfur-sensitive reforming catalyst.

II. BACKGROUND AND PROBLEMS

Reforming, or hydroforming, is a well established industrial process employed by the petroleum industry for upgrading virgin or cracked naphthas for the production of high octane gasoline. Reforming is defined as the total effect of the molecular changes, or hydrocarbon reactions produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins to produce gas and coke. Historically, noble metal catalysts, notably platinum supported on alumina, have been employed for this reaction. More recently, polymetallic catalysts consisting of platinum-rhenium, platinum-iridium, platinum-tin, or various combinations thereof promoted with any one or more of the following elements copper, selenium, sulfur, chloride, and fluoride, have been utilized.

In a typical process, a series of reactors are provided with fixed beds of catalyst which receive downflow feed, and each reactor is provided with a preheater or interstage heater, because the desirable reactions which take place are endothermic. A naphtha feed, with hydrogen, or recycle gas, is cocurrently passed through a reheat furnace and reactor, and then in sequence through subsequent heaters and reactors of the series. The vapor effluent from the last reactor of the series is a gas rich in hydrogen, which usually contains small amounts of normally gaseous hydrocarbons, from which hydrogen is separated from the $C_5+$ liquid product and recycled to the process to minimize coke production; coke invariably forming and depositing on the catalyst during the reaction.

Essentially all petroleum naphtha feeds contain sulfur, a well known catalyst poison which can gradually accumulate upon and poison the catalyst. Most of the sulfur, because of this adverse effect, is generally removed from feed naphthas, e.g., by hydrofining with conventional hydrodesulfurization catalysts consisting of the sulfides of cobalt or nickel and molybdenum supported on a high surface area alumina. The severity of hydrofining can be increased so that essentially all the sulfur is removed from the naphtha in the form of $H_2S$. However, small quantities of olefins are also produced. As a consequence, when the exit stream from the hydrofiner is cooled, sulfur can be reincorporated into the naphtha by the combination of $H_2S$ with the olefins to produce mercaptans. Hence, if a refiner is willing to pay the price, a hydrofiner can be employed at high severity to remove nearly all of the sulfur from a feed, but it is rather costly to maintain a product which consistently contains less than about 1–2 parts per million by weight of sulfur, and of course, during hydrofiner upsets the sulfur concentration in the hydrofined product can be considerably higher, e.g., as high as 50 ppm, or greater.

In reforming, sulfur compounds, even at a 1–2 parts per million weight range contribute to loss of catalyst activity and $C_5+$ liquid yield, particularly with the new sulfur-sensitive polymetallic catalysts used by refiners in recent years. Since the late sixties, in particular, polymetallic metal catalysts have been employed to provide, at reforming conditions, improved catalyst activity, selectivity and stability. Thus, additional metallic components have been added to the more conventional platinum catalysts as promotors to further improve, particularly, the activity or selectivity, or both, of the basic platinum catalyst, e.g., iridium, rhenium, tin, and the like. In the use of these catalysts it has become essential to reduce the feed sulfur to only a few parts per million by weight, wppm. For example, in the use of platinum-rhenium catalysts it is generally necessary to reduce the sulfur concentration of the feed well below about 2 wppm, and preferably below about 0.1 wppm, to avoid excessive loss of catalyst activity and $C_5+$ liquid yield. By removing virtually the last traces of sulfur from the naphtha feed, catalyst activity and $C_5+$ liquid yield of high octane gasoline can be significantly increased.

The sulfur-containing feed, prior to reforming, is hydrofined over a Group VI-B or Group VIII catalyst, e.g., a Co/Mo catalyst, and a major amount of the sulfur is removed. Residual sulfur is then generally removed from the naphtha feeds by passage through a "sulfur trap," guard chamber, or reactor which contains a fixed bed of catalyst, or adsorbent through which the feed is passed to remove residual amounts of sulfur. Within the sulfur trap, e.g., residual sulfur is removed from the naphtha feeds by adsorption over copper chromite, nickel, cobalt, molybdenum, and the like. These and other metals have been found useful per se, or have been supported on high surface area refractory inorganic oxide materials such as alumina, silica, silica/alumina, clays, kieselguhr, and the like. Massive nickel catalysts, or catalysts containing from about 10 percent to about 70 percent nickel, alone or in admixture with other metal components, supported on an inorganic oxide base, notably alumina, have been found particularly effective in removing sulfur from naphtha feeds, notably naphtha feeds containing from about 1 to about 50 ppm sulfur, or higher.

Albeit it is known to remove sulfur from sulfur-containing hydrofined feeds by contacting, or flowing such feeds in liquid phase through a sulfur trap containing a catalyst composite constituted of nickel supported on alumina at elevated temperatures, there nonetheless remains a need for further improving the sulfur capacity and removal rate of such catalyst composites.

III. OBJECTS

It is, accordingly, the primary objective of this invention to fill this need. It is, more particularly, an object of this invention to provide a liquid phase sulfur trap which contains a catalyst composite constituted of nickel supported on alumina which has increased sulfur capacity and faster removal rate for the removal of sulfur than previously used sulfur traps containing supported massive nickel catalysts.

A specific object is to provide an improved nickel-alumina sulfur trap, as characterized, which is particularly useful for removing sulfur from hydrofined products employed as low sulfur reformer feeds, especially one for use in the sulfur cleanup of hydrofiner products employed as feeds to reforming units which contain sulfur sensitive reforming catalysts.

IV. SUMMARY OF THE INVENTION

These and other objects are achieved in accordance with this invention, characterized generally as a process wherein a sulfur trap is packed with a bed of nickel adsorbent of large crystallite size in highly reduced form, supported on alumina, and located between a hydrofiner and reforming unit. In general, the nickel is supported on alumina in concentration ranging from about 10 percent to about 70 percent, preferably above about 45 percent, more preferably from about 45 percent to about 55 percent, based on the total weight of the catalyst (dry basis). At least 50 percent, and preferably at least 60 percent of the nickel is present in reduced state, and the metal crystallites are greater than 75 Angstrom units, Å, average diameter, and preferably at least 95 Å average diameter. In particular, the nickel component of the adsorbent ranges from about 45 percent to about 55 percent, preferably from about 48 percent to about 52 percent elemental, or metallic nickel, based on the total weight of the supported component (dry basis). The size of the nickel crystallites range above about 75 Å to about 500 Å, preferably from about 100 Å to about 300 Å, average diameter. It has been found, quite surprisingly, that a nickel adsorbent so characterized is far more effective for sulfur uptake than a supported nickel catalyst, or adsorbent of equivalent nickel content with smaller metal crystallites.

The alumina component of the nickel-alumina adsorbent, or catalyst is preferably gamma alumina, and contains a minimum of contaminants, generally less than about 1 percent based on the weight of the catalyst (dry basis). In particular, the alumina is of low silica content. In general, the silica content should not exceed about 0.7 percent, and preferably ranges between about 0 and 0.5 percent, based on the weight of the alumina (dry basis).

The product of the hydrofiner (i.e., one containing from about 1–50 ppm sulfur), generally boiling within a range of from about $C_5$+ to 430° F. is passed through the sulfur trap, or guard chamber containing the nickel on alumina catalyst. Preferably, the temperature of the feed passed through the guard chamber is maintained at from about 300° F. to about 500° F., more preferably from about 350° F. to about 500° F. Sulfur from the feed, primarily in the form of mercaptans, thiophene, hydrogen sulfide, and the like, is chemically adsorbed on the nickel catalyst.

These and other features of the invention will be better understood by reference to the attached drawing of a highly preferred process, and to a more detailed description thereof.

V. REFERENCE TO THE DRAWING

In the drawing:

The FIGURE schematically depicts the combination of a hydrofiner, sulfur trap, and reforming unit. Pumps, compressors, and auxiliary equipment are omitted for clarity.

Referring to the FIGURE, a hydrofined petroleum naphtha feed from hydrofiner H/F is passed serially through a deethanizer and a debutanizer, and the partially desulfurized feed from the debutanizer is passed through a nickel catalyst containing sulfur trap. During normal operation the hydrofiner H/F removes sufficient of the feed sulfur to provide a product containing from about 1 ppm to about 5 ppm sulfur, generally from about 0.5 to about 2 ppm sulfur.

The sulfur trap generally contains a fixed bed of massive nickel catalyst, the nickel being supported on alumina in concentration ranging generally from about 10 percent to about 70 percent, preferably from about 45 percent to about 55 percent, and more preferably from about 48 percent to about 52 percent nickel, based on the total weight of the catalyst (dry basis).

The reforming unit is comprised of a multi-reactor system, three reactors being shown for convenience, viz. Reactors $R_1$, $R_2$, and $R_3$ each of which are connected in series and preceded by a heater or preheat furnace, $F_1$, $F_2$, and $F_3$, respectively. The desulfurized feed is serially passed with hydrogen through $F_1R_1$, $F_2R_2$, and $F_3R_3$ with the products from the reactions being passed to a high pressure separator HPS. Each reactor is packed with fixed beds of a sulfur sensitive polymetallic platinum catalyst heretofore described, suitably a platinum-rhenium-alumina catalyst or a platinum iridium-alumina catalyst. A portion of the hydrogen-rich make gas can be taken from the top of the high pressure separator HPS and, after passage through a make gas compressor, recycled to the hydrofiner, H/F, and another portion recycled through gas driers to the lead furnace and reactor $F_1R_1$. Substantially all, or a major portion of the moisture and sulfur are scrubbed and removed from the recycle gas by the recycle gas drier loaded, e.g., with a zinc alumina spinel sorbent to maintain a dry, low-sulfur system. $C_5$+ liquids from the bottom of high pressure separator HPS are sent to a stabilizer, or to tankage.

The following examples, and comparative demonstrations, describe the removal of sulfur from paraffinic naphthas by adsorption with the supported nickel catalysts of this invention, and supported nickel catalysts not of this invention. In one type of demonstration similar charges of the different catalysts were immersed in corresponding amounts of the sulfur-containing paraffinic naphtha and treated at similar conditions in an autoclave to test the effectiveness of each type of catalyst for adsorbing sulfur from the naphtha. In another, corresponding charges of the sulfur-containing naphtha at elevated temperature were passed through fixed beds containing similar charges of the different catalysts at similar conditions and the time required for breakthrough of the sulfur in the effluent from the exit side of the fixed bed measured. Sulfur breakthrough occurs when the catalyst becomes saturated with sulfur, and its capacity for adsorbing sulfur is exceeded. The time required for breakthrough thus serves as a measure of the relative sulfur adsorption capacity of the two different catalysts.

In the example immediately following the effectiveness of a nickel catalyst of this invention having a large Ni crystallite size is contrasted with that of a nickel catalyst having nickel crystallites of relatively small size for the removal of n-hexyl mercaptan from a light paraffinic naphtha.

EXAMPLES 1–2

Adsorbent A was prepared as 1/16" extrudates to contain approximately 50 wt. % Ni on an alumina base with low silica content. Adsorbent B is a commercially available hydrogenation catalyst the nickel component of which is deposited on a 1/16" extrudate of the alumina base. Both adsorbents were pre-reduced at 700°-800° F. and then stabilized with $CO_2$. Comparative properties of Adsorbent A and B are listed in Table IA.

TABLE IA

| | Adsorbent A | Adsorbent B |
|---|---|---|
| Nickel, Wt. % | 52 | 50 |
| Ni Crystallite Size, Å | 92 | 75 |
| Ni Metal Surface Area, $m^2/g$ | 52 | 80 |
| % Reduced Nickel | 65 | ~50 |
| Silica, Wt. % | 0.4 | 15.3 |
| Surface Area, $m^2/g$ | 166 | 120 |
| Pore Volume, cc/g | 0.45 | 0.48 |

Adsorbents A and B, which contain essentially equivalent amounts of nickel, were each similarly tested in an autoclave at 500° F. and 275 psig to test their effectiveness for sulfur removal. The results are tabulated in Table IB.

TABLE IB

| | Adsorbent A | Adsorbent B |
|---|---|---|
| Wt. % Sulfur Adsorbed at Saturation | 17.5 | 15.4 |

Quite clearly, despite the fact that adsorbent B has approximately 60 percent greater nickel surface area, Adsorbent A which contains nickel of greater average crystallite size and is more highly reduced is a more effective adsorbent for the removal of sulfur from the sulfur-containing paraffinic naphtha.

Adsorbents A and B, respectively, were again employed without prereduction for use in adsorbing sulfur from a sulfur-containing feed. These runs were conducted in a fixed bed test at 350° F., 17 WHSV, with ~3 wppm sulfur as n-pentylmercaptan in a paraffinic naphtha. Each run was terminated on breakthrough of sulfur in the effluent. Adsorbent A was onstream approximately 1500 hours before sulfur was detected in the product naphtha, whereas Adsorbent B gave detectable sulfur after 800 hours. These results clearly demonstrate the superiority of Adsorbent A for sulfur removal.

EXAMPLE 3

A second batch of adsorbent was used to produce 1/32" extrudates, this batch of adsorbent being designated Adsorbent C. Its properties are listed in the following Table IIA.

TABLE IIA

| | Adsorbent C |
|---|---|
| Nickel, Wt. % | 49 |
| Ni Crystallite Size, Å | 299 |
| Ni Metal Surface Area, $m^2/g$ | 31 |
| % Reduced Nickel | 78 |
| Silica, Wt. % | 0.6 |
| Surface Area, $m^2/g$ | 133 |
| Pore Volume, cc/g | 0.49 |

Adsorbent C was also pre-reduced in a hydrogen-containing gas and then passivated with $CO_2$. It was tested in a fixed bed pilot plant as 1/32" extrudates at 400° F., 275 psig, 10 WHSV with nominally 100 wppm sulfur (as n-pentylmercaptan) in paraffinic naphtha. Adsorbent C was compared with commercial grade Adsorbent B prepared as 1/32" extrudates (Adsorbent D). Neither Adsorbent C nor Adsorbent D was rereduced prior to introducing naphtha feed. The results are tabulated in Table IIB.

TABLE IIB

| | Adsorbent C | Adsorbent D |
|---|---|---|
| Sulfur Removed at Breakthrough, calc. Wt. % on Adsorbent | 21.1 | 11.0 |
| Sulfur Adsorption Rate Constant (dimensionless) | 4.3 | 2.2 |

This accelerated test again shows a significant improvement in sulfur removal with Adsorption C.

EXAMPLE 4

Adsorbents C and D were oxidized in a gas stream containing 2% $O_2$ in $N_2$ at 750° F. in a thermal gravimetric analyzer (TGA) until no further weight gain was recorded. Then $H_2$ was introduced (after inert purging) and the weight loss recorded. From these data and chemical determination of Ni concentration present, % reduced Ni could be calculated. Table III compares the results for two oxidation-reduction cycles:

TABLE III

| | % Reduced Nickel | |
|---|---|---|
| Cycle # | Adsorbent C | Adsorbent D |
| 1 | 90 | 76 |
| 2 | 100 | 85 |

These data show Adsorbent C (with initially higher reduced Ni) remains more reducible, with a higher fraction of metallic Ni possible than with Adsorbent D. Despite oxidation at 750° F., Adsorbent C yields a higher fraction of reduced Ni than Adsorbent D upon subsequent reduction in hydrogen. This effect may be related to the base composition or possibly the larger Ni crystallites on C retain their "memory" of initial state when oxidized and re-reduced at these conditions. Furthermore, a single experiment comparing Adsorbent A and Adsorbent B for n-pentylmercaptan removal from a hydrogen containing gas stream at 500° F. shows that even in this reducing atmosphere, the sulfur capacity of Adsorbent A (higher fraction of reduced Ni) is 50% greater than Adsorbent B.

EXAMPLE 5

Adsorbent E was prepared using similar procedures as for Adsorbents A and C. Adsorbent F is a commercial hydrogenation catalyst. Comparative properties are listed in Table IVA.

TABLE IVA

| | Adsorbent E (1/32" Extrudates) | Adsorbent F (1/32" Extrudates) |
|---|---|---|
| Nickel, Wt. % | 48.2 | 50.2 |
| Ni Metal Surface Area, $m^2/g$ | 60 | 103 |
| % Reduced Nickel | 78 | 54 |
| Surface Area, $m^2/g$ | 158 | 144 |

Adsorbents E and F were evaluated for adsorption of $H_2S$ from an inert gas stream using the TGA apparatus. In two separate experiments approximately 100 mg of each adsorbent were charged, heated to 900° F. in argon until no further weight loss was observed, and then cooled to 500° F. in flowing argon. Then a stream consisting of 2 vol. % $H_2S$/98 vol. % argon was introduced and weight gain due to sulfur adsorption measured with time until lineout at 500° F. The results are tabulated in Table IVB

TABLE IVB

| | Adsorbent E | Adsorbent F |
|---|---|---|
| Sulfur Saturation Capacity, Wt. % | 31.6 | 25.1 |
| Initial Sulfur Adsorption Rate, g S/min-g Adsorbent | 0.005 | 0.003 |

These data further confirm the superiority of nickel adsorbents with a higher fraction of the total nickel present in the reduced or metallic state. Quite unexpectedly, a sulfur adsorption improvement is achieved using a massive nickel catalyst wherein at least 60% of the nickel present is reduced to the metallic state. A high purity alumina base is also preferred, with minimal silica present. This invention may be applied to effectively remove mercaptans, thiophenes, disulfides, $H_2S$ and the like from gaseous or liquid streams at temperatures of 200°–1000° F. and pressures ranging from 50–500 psig. A preferred embodiment is the use of adsorbent of this invention to scavenge trace sulfur contaminants from catalytic reformer naphtha feed.

It is apparent that various modifications and changes can be made without departing the spirit and scope of the invention.

Having described the invention, what is claimed is:

1. In a process which includes in combination a hydrofiner, sulfur trap, and reforming unit, said hydrofiner located upstream of the reforming unit, for hydrofining a sulfur-containing naphtha to remove a major portion of the sulfur, said sulfur trap located downstream of said hydrofiner which contains a nickel catalyst constituted of from about 10 weight percent to about 70 weight percent nickel dispersed on a support, the low-sulfur naphtha from the hydrofiner being passed therethrough and contacted with the nickel catalyst to remove sulfur from the naphtha, said reforming unit for reforming, with hydrogen, the low-sulfur naphtha from the hydrofiner and nickel-containing sulfur trap, the reforming unit containing a plurality of catalyst-containing on-stream reactors connected in series, the hydrogen and low-sulfur naphtha feed flowing from one reactor of the series to another to contact the catalyst contained therein at reforming conditions, the improvement wherein the nickel catalyst contained in said sulfur trap is one wherein the average crystallite size of the nickel is greater than 92 Å and nickel surface area ranges between about 31 $m^2/g$ and about 52 $m^2/g$, and at least 50 percent of the nickel is in reduced state, based on the total weight of the supported component.

2. The process of claim 1 wherein the average crystallite size of the nickel is at least about 95 Å.

3. The process of claim 1 wherein the average crystallite size of the nickel ranges from about 92 Å to about 500 Å.

4. The process of claim 1 wherein the average crystallite size of the nickel ranges from about 100 Å to about 300 Å, and from about 45 percent to about 55 percent elemental nickel, based on the total weight of the supported component.

5. The process of claim 1 wherein the average crystallite size of the nickel of the nickel catalyst contained in said sulfur trap is at least about 95 Å, and at least 60 percent of the nickel is in reduced state, based on the total weight of the supported component.

6. The process of claim 1 wherein the average crystallite size of the nickel is at least about 100 Å.

7. The process of claim 1 wherein the average crystallite size of the nickel ranges from about 100 Å to about 300 Å.

8. The process of claim 1 wherein the average crystallite size of the nickel of the nickel catalyst contained in said sulfur trap ranges from about 100 Å to about 300 Å, and ranges from about 45 percent to about 55 percent elemental nickel, based on the total weight of the supported component.

9. The process of claim 1 wherein the nickel catalyst contained in said sulfur trap is one wherein the average crystallite size of the nickel ranges from about 100 Å to about 300 Å, at least 60 percent of the nickel is in reduced state, based on the total weight of the supported component, and from about 48 percent to about 52 percent of the catalyst is constituted of elemental nickel, based on the total weight of the supported component.

10. The process of claim 1 wherein the naphtha obtained from the guard chamber for passage to the reforming unit contains less than 2 parts per million parts of sulfur, based on the weight of said naphtha.

11. The process of claim 10 wherein the naphtha contains less than 0.5 parts per million parts of sulfur.

* * * * *